US005129750A

United States Patent [19]

Otsuki

[11] Patent Number: 5,129,750

[45] Date of Patent: Jul. 14, 1992

[54] OPENING MECHANISM FOR A PRINTER

[75] Inventor: Chihiro Otsuki, Suwa, Japan

[73] Assignee: Seiko Epson Corporation, Tokyo, Japan

[21] Appl. No.: 584,746

[22] Filed: Sep. 19, 1990

[30] Foreign Application Priority Data

Sep. 22, 1989 [JP] Japan ..... 1-247557

[51] Int. Cl.[5] ..... B41S 29/02

[52] U.S. Cl. ..... 400/690.4; 292/254; 346/145; 400/692

[58] Field of Search ..... 400/691, 692, 613.1, 400/690.4, 693, 688, 663, 664; 346/145; 292/254, 124, 126, 224, 226, DIG. 71, DIG.72

[56] References Cited

U.S. PATENT DOCUMENTS 4,531,852 7/1985 Mädge et al. ..... 400/680 X 4,562,444 12/1985 Nagashima et al. ..... 346/145 X

FOREIGN PATENT DOCUMENTS 24187 3/1981 Japan ..... 400/693

125685 7/1985 Japan ..... 400/693

*Primary Examiner*—Edgar S. Burr

*Assistant Examiner*—Moshe I. Cohen

*Attorney, Agent, or Firm*—Blum Kaplan

[57] ABSTRACT

A printer includes a clam shell mechanism having a frame rotatably mounted on a base. A platen is mounted on the frame. A print head for acting in cooperation with the platen is mounted on the base. A locking lever mounted on the base cooperates with a shaft mounted on the first frame for selectively maintaining the first frame in a closed position. A lock control member switches the locking means between maintaining the first frame in the closed position and allowing the first frame to rotate to an open position wherein the platen is displaced from the print head.

11 Claims, 4 Drawing Sheets

OPENING MECHANISM FOR A PRINTER

BACKGROUND OF THE INVENTION

This invention relates to a printer used with (Electronic Cash Register) ECR, (Automatic Teller Machine) ATMs and the like, and in particular, an opening mechanism for opening the printing portion thereof during a paper jam, an ink ribbon exchange or the setting and removing of the recording media.

Prior art printers include fixed components which allow for a space of only about 0.6 mm between the print head and the platen. In such printers, it is quite difficult to remove jammed paper. Such a drawback often results in the requirement of a service call to repair a simple paper jam.

An apparatus for allowing a printer to be opened and closed at a portion of the printer between the print head and the platen has also been developed in the prior art. Once such apparatus requires the removing of the entire print mechanism to cure such paper jams or to access the print area. However, it is difficult to remove or reset the unit once it has been removed. Additionally, an improper removal operation easily leads to damage of the system. Lastly, it is required that when rolled paper is the print media, that the rolled paper be re-inserted at each reset of the machine, a complicated troublesome process.

A second mechanism known in the prior art allows for the rotation or movement of the entire unit. However, such a rotation structure is quite complicated. Additionally, the operation requires rotation or movement and resetting of the printer which are also quite troublesome. Additionally, as the system is rotated away from and returned to the print position over time, the gap between the print head and platen varies worsening print quality.

Accordingly, the prior art printers have suffered from serious operating and print quality problems. The maintenance work such as removing jammed paper, an incidence which occurs quite easily in the prior art printers used in ECR or the like, is quite time consuming. Additionally, the operation of such mechanisms is usually so complex or difficult that an operator cannot remedy the situation himself requiring a service call. Even when the operator is able to remove a paper jam, such an operation is quite time consuming.

Accordingly, it is desired to provide a simple printer structure which includes a mechanism for allowing easy access to paper jams and the ink ribbon.

SUMMARY OF THE INVENTION

Generally speaking, in accordance with the invention, a printer includes a base. A frame is rotatably mounted on the base. A platen is positioned within the rotatable frame. A print head is mounted on the base. The rotatable frame is rotatable between closed and open positions to displace the platen away from the print head when in the open position. The center of rotation of the rotatable frame is supported on the base. A lock member mounted on the base maintains the rotatable frame in a closed print state. A lock control member switches the rotatable frame between the open positioned and the closed position.

Accordingly, it is an object of this invention to provide an improved mechanism for opening a printer.

Another object of the invention is to provide a inexpensive printer capable of maintaining good print quality as well as being capable of extremely smooth operations at the time of removing jammed paper, exchanging ribbon and exchanging rolled paper.

Yet another object of the invention is to provide a mechanism for opening a printer which is activated by the mere operation of a lever to open a space between the print head and platen.

Still other objects and advantages of the invention will in part be obvious and will in part be apparent from the specification.

The invention accordingly comprises the features of construction, combination of elements and arrangement of parts which will be exemplified in the constructions hereinafter set forth and the scope of the invention will be indicated in the claims.

BRIEF DESCRIPTION OF THE DRAWINGS

For a fuller understanding of the invention, reference is had to the following description taken in connection with the in accompanying drawings, in which.

DETAILED DESCRIPTION OF THE PREFERRED EMBODIMENTS

Figure 1:
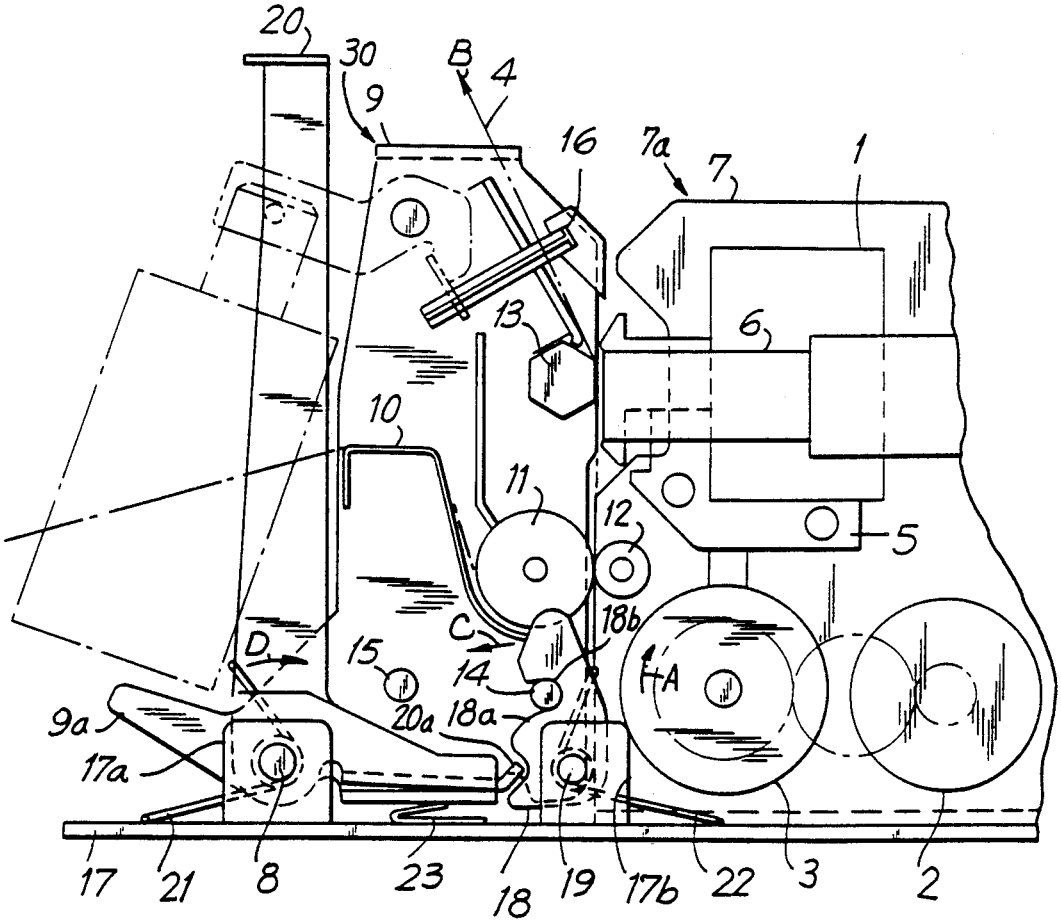
FIG. 1 is a side elevational view of a printer constructed in accordance with the invention in a print standby state.

Reference is first made to FIG. 1 in which a printer constructed in accordance with the invention is provided. A base frame 17 supports a main frame 7. A head carriage 5 is mounted within main frame 7 and travels a reciprocal path along the width of rolled paper 4. A print head 1 is fixed on head carriage 5 and moves there with. A transporting cam 3 rotates in the direction of arrow A to move head carriage 5. Transporting cam 3 is coupled to a motor 2 to drive cam 3.

An ink ribbon 6 is fed about print head 1 by a ribbon feed mechanism positioned on main frame 7. A tachometer located within motor 2 generates timing pulses. The tachometer uses the timing signal formed by a waveform generating circuit as a basic clock for controlling printing, paper feed and the like as is known in the prior art. A main housing unit, generally indicated as *7a* includes the printing portion of the printer, which is the main part of this unit, which includes the above components as well as a reset detector which detects the home position of print head 1.

An openable paper feed frame unit, generally indicated as 30, includes a paper feed frame 9 which is rotatably mounted about a support shaft 8 mounted on base frame 17. A paper guide 10 is disposed within paper feed frame 9 and guides rolled paper 4 therethrough. Paper 4 is fed through the printer by a paper feed roller 11 and paper support roller 12 mounted on paper feed frame 9 downstream of print head I in the paper pathway. A platen 13 is mounted on paper feed frame 9 at a print position adjacent print head 1. An automatic cutting device 16 is disposed upstream in the paper feed path of platen 13 for cutting rolled paper 4 into sheets.

A lock lever shaft 19 is mounted on base frame 17. A lock lever 18 is rotatably mounted about lock lever shaft 19. A lock shaft 14 is mounted on paper feed frame 9 and is received by a lock lever 18, a stopper shaft 15 is also mounted on paper feed frame 9.

Main housing unit 7*a* and paper feed frame unit 30 are both mounted on base frame 17. Main housing unit 7*a* is fixed to base frame 17. On the other hand, paper feed frame unit 30 is rotatable about the fulcrum of support shaft 8 which in turn is supported by a pair of flexures 17*a* formed on with base frame 17. A second pair of flexures 17*b* are provided on base frame 17 and are provided with fulcrum shaft holes therein for receiving lock lever shaft 19. Lock lever shaft 19 acts as the fulcrum of lock lever 18. Lock lever 18 maintains paper feed frame unit 30 at the prescribed printing position when engaged with lock shaft 14 at a concave portion 18*b* of lock lever 18. A lock lever spring 22 supported on a base frame 17 about lock lever shaft 19 biases lock lever 18 in the direction of arrow C.

A mechanism which allows a printer to open and close by rotating a portion thereof away from another portion is known as a clam shell mechanism. A lock control lever 20 is rotatably mounted about fulcrum shaft 8. A lock control lever spring 21 biases lock control lever 20 about fulcrum shaft 8 in the direction of arrow D so that the clam shell mechanism can be controlled merely by operating lock control lever 20. A shift spring 23 is disposed between paper feed unit 30 and base frame 17 to adjust dimensional aberrations which accumulate due to the accumulated aberrations attributable to wear and other factors on various parts. Shift spring 23 bias paper feed unit 30 in the direction in which platen 13 is impacted by print head 1, thus preventing a worsening of print quality caused by a variation of platen gaps which may easily become a drawback of clam shell mechanisms.

Figure 4:
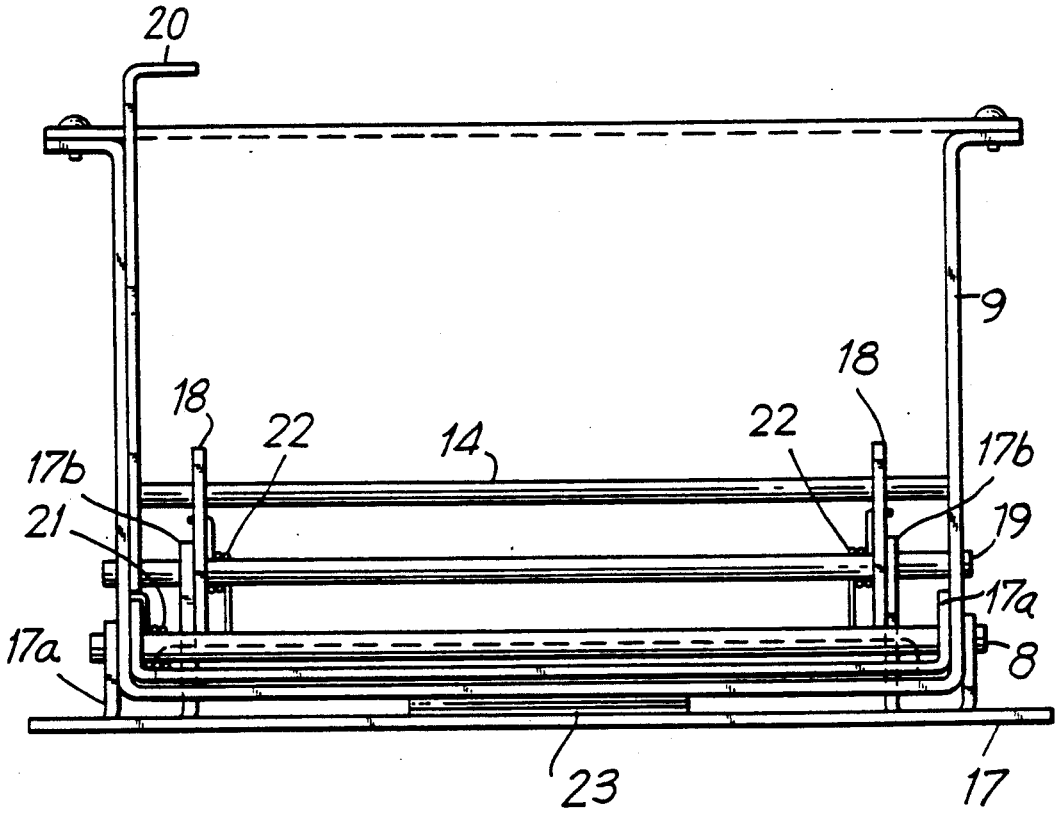
FIG. 4 is a front plan view of the printer constructed in accordance with the invention in a standby state.

As can be seen from FIG. 4, FIG. 1 represents only one side of the clam shell mechanism. Accordingly, the described embodiment includes two lock levers 18 along with the two associated springs 22, flexures 17*a* and flexures 17*b*.

Figure 2:
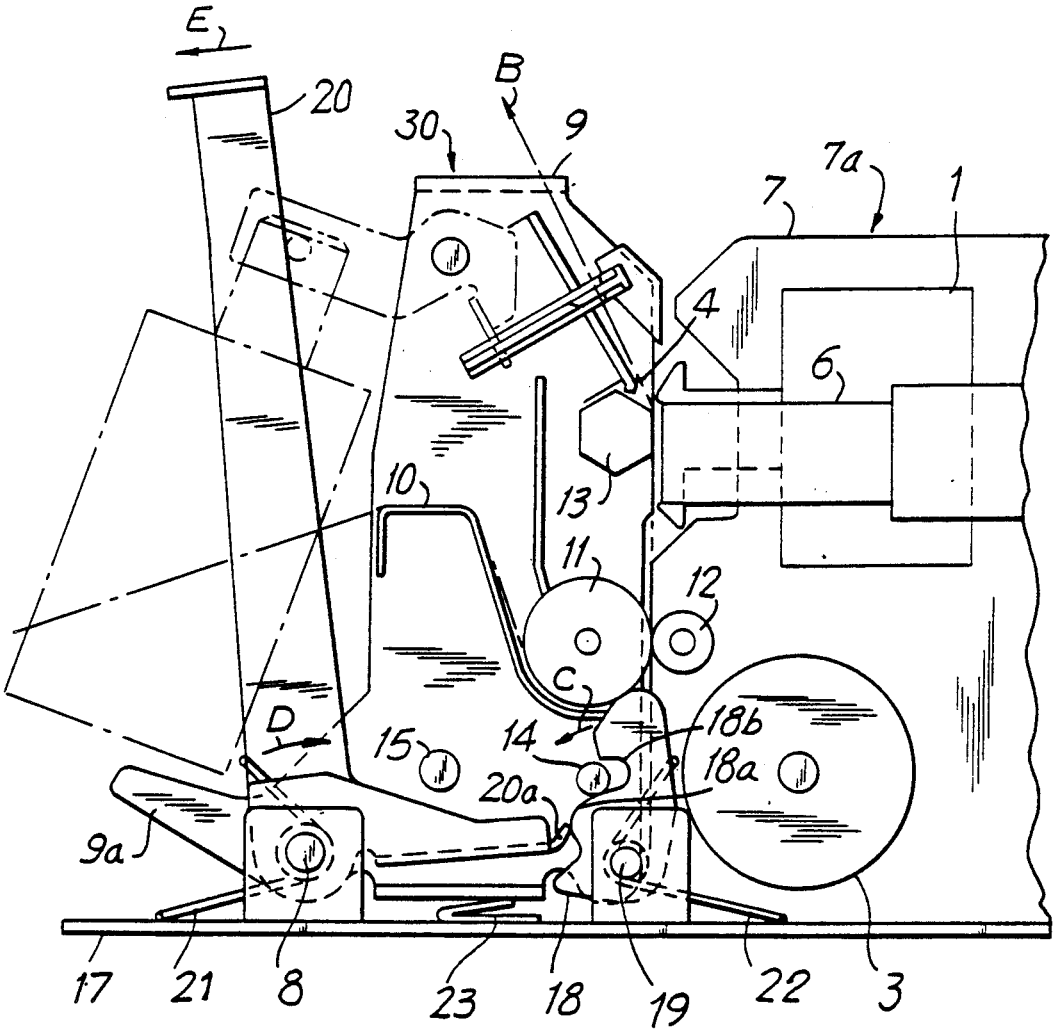
FIG. 2 is a side elevational view of the mechanism of FIG. 1 in a unlocked state.
Figure 3:
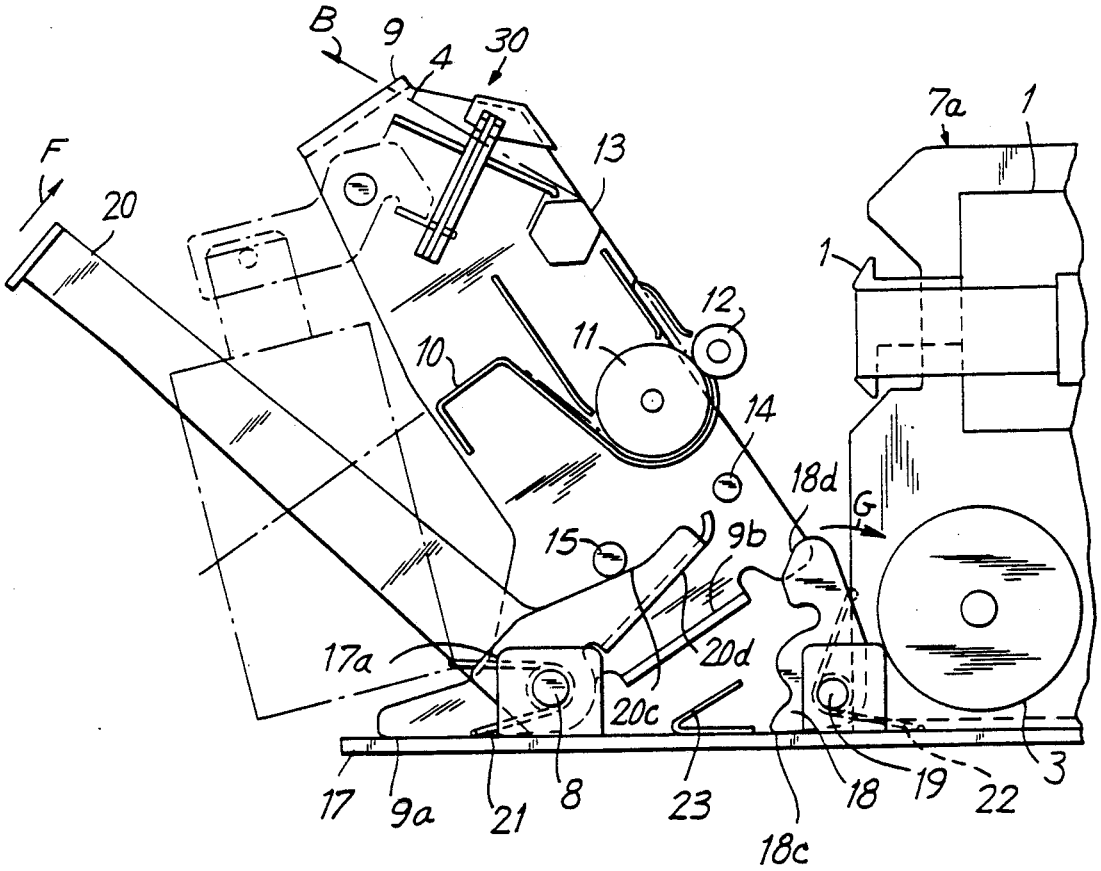
FIG. 3 is a side view of the printer constructed in accordance with the invention in an opened state.

Reference is now made to FIGS. 2 and 3 in which the opening of the clam shell mechanism is illustrated. As seen, lock control lever 20 is formed with a flexed tip 20*a*. Lock lever 18 is formed with a convex portion 18*a*. As seen in FIG. 2, the locked state is cancelled by slightly pushing lock control lever 20 in the direction of arrow E. Flexed tip 20*a* contacts convex portion 18*a* of lock lever 18 as control lever 20 is rotated. This causes lock lever 18 to rotate cancelling the locked condition between lock shaft 14 and concave portion 18*b*. The rotation of lock lever 18 is in a direction opposite to that of arrow C against the spring force of lock lever spring 22.

Reference is now made to FIG. 3 showing the clam shell mechanism at a later moment in time in which lock lever 20 has been pushed even further in the direction of arrow E. Paper feed frame 9 has now also been rotated in the direction of arrow E so that the printing portion of the printer which includes print head 1 and platen 13 is opened. A stopper shaft 15 disposed on paper feed frame 9 comes in contact with a bent reclined portion 20*c* of lock control lever 20 so that rotation of lock control lever 20 rotates paper feed frame 9. Paper feed frame 9 may be rotated about fulcrum shaft 8 until a stopper 9*a* integrally formed with paper feed frame 9 comes in contact with a base frame 17. The angle of the opening can be freely chosen by varying the position of stopper 9*a*. Additionally, although a coil spring i employed as lock lever spring 21 in this embodiment, the locked state and open state can be maintained by employing two ANTEI springs. Accordingly, paper jams can easily be corrected in a short time since the printing portion is completely opened as shown in FIG. 3.

The opened state in FIG. 3 may be easily returned to the closed state of FIG. 1. A flexed bottom 20*d* of lock lever 20 pushes down a flexure 9*b* of paper feed frame 9 as control lever 20 is pushed in the direction of arrow F causing paper feed unit 9 to rotate in the direction of arrow G. As paper feed frame 9 rotates, lock shaft 14 contacts a diagonal portion 18*d* of lock lever 18 rotating lock lever 18 in the direction of arrow G. As lock lever 14 rotates to within, concave portion 18*b* of lock lever 18, lock lever 18 is then biased in the direction of arrow C by spring 22 to maintain lock shaft 14 locked therein, thus maintaining paper feed frame 9 in a closed standby print position.

As seen from FIG. 4 this embodiment is depicted as containing two locking levers 18 and a corresponding lock lever spring 22 at each side. However, the invention will operate equally as well with a single lock mechanism at the center of the printer.

By providing a simple rotatable frame structure controlled by a lever and spring mechanism, when removing jammed paper, exchanging ribbons, exchanging a rolled paper supply or the like, the main housing unit and paper feed unit can be easily switched between an open state and closed printing state by operating the lock control lever. In the open state, the space between the print head and platen becomes wide providing a smooth operating printer which also enable easy removal of jammed paper and exchange of ribbons and rolled paper. By inserting a shift spring to absorb vibration between the rotatable paper feed unit and the base frame as well as making the position of the lock shaft adjustable, no variation in the platen gap arises from repeated opening and closing of the clam shell mechanism and accordingly there is no worsening of the print quality.

By providing a clam shell mechanism as described above, paper jams, ink ribbon changes and the like are no longer a drawback in a printer and may be accomplished in a short time due to the easy operation provided by the lever. Additionally, the cost of such printers is reduced due to the simple structure and simple components. Lastly, the gap between the print head and platen which is so easily deteriorated in a clam shell mechanism is further prevented from fluctuation by biasing the paper feed unit in the direction in which the platen receives the impact from the print head.

It will thus be seen that the objects set forth above, among those made apparent from the preceding description are efficiently attained and, since certain changes may be made in the above construction set forth, without departing from the spirit and scope of the invention, it is intended that all matter contained in the above description and shown in the accompanying drawings shall be interpreted as illustrative and not in a limiting sense.

It also to be understood that the following claims are intended to cover all of the generic and specific features of the invention herein described and all statements of the scope of the invention which, as a matter of language might be said to fall therebetween.

What is claimed is:

1. A printer comprising:

a base;

a frame rotatably mounted on said base;

a platen mounted on said frame;

printing means mounted on the base for acting in cooperation with the platen to perform printing, the frame being rotatable between closed and open positions to displace the platen away from the printing means when in the open position;

locking means mounted on the base and the frame for selectively maintaining the frame in the closed position, the locking means including a lock shaft mounted on the frame and a lock lever rotatably mounted on the base; and a lock control member for switching the locking means from maintaining the frame in the closed positioned to permit the frame to rotate to the open position, the lock control member having a first end and a second end, a stopper member extending from said frame and positioned in the path of movement of said lock control member, said lock control member being rotatably mounted on the base and selectively contacting the lock lever at said first end, said second end being manually actuatable causing said lock control member to engage said stopper member and thereby rotate said frame between said closed position and said open position.

2. The printer of claim 1, wherein the lock lever is formed with a concave portion for receiving and maintaining the lock shaft to maintain the frame in the closed position.

3. The printer of claim 2, wherein the lock control member rotates the lock lever causing the lock shaft to be released from the concave portion.

4. The printer of claim 1, wherein said lock control member rotates the frame into the open position.

5. The printer of claim 1, further comprising biasing means for biasing the frame in a direction to bring the platen into the desired relation with the printing means when the frame is in the closed position.

6. The printer of claim 1, further comprising a shaft, the shaft being mounted on the base, the frame being mounted on the shaft, the center of rotation of the frame being the shaft.

7. The printer of claim 6, wherein said shaft extends in a direction substantially parallel to said base.

8. The printer of claim 5, wherein said biasing means is a spring disposed between said base and said frame.

9. The printer of claim 2, further comprising second biasing means for biasing said lock lever toward said lock shaft.

10. The printer of claim 9, further comprising a second shaft mounted on said base, said lock lever rotatably mounted about said shaft, and said second biasing means including a spring mounted about shaft.

11. A printer comprising:

a base;

a frame rotatably mounted on said base;

a platen mounted on said frame;

a second frame fixedly mounted on said base;

printing means mounted on the base for acting in cooperation with said platen to perform printing, said frame being rotatable between closed and open positions to displace the platen away from said printing means when in the open position;

locking means mounted on the base and the first frame for selectively maintaining the frame in the closed position, the locking means including a lock shaft mounted on the frame and a lock lever rotatably mounted on the base, the lock lever being formed with a concave portion for receiving and maintaining the lock lever to maintain the first frame in the closed position;

a lock control member for switching the locking means from maintaining the first frame in the closed positioned to permit the frame to rotate to said open position and rotating the frame into the open position;

a stopper member extending from the frame and positioned in the path of movement of the lock control member, said lock control member engaging said stopper member to rotate said frame from said closed to said open position; and biasing means for biasing the frame in a direction to bring the platen into the desired relation with the printing means when the frame is in the closed position.

* * * * *